US008602318B2

(12) United States Patent
Rode

(10) Patent No.: US 8,602,318 B2
(45) Date of Patent: Dec. 10, 2013

(54) METHOD OF COVERING A RAIL FOR A RAILWAY VEHICLE

(75) Inventor: Joseph Rode, Grimbergen (BE)

(73) Assignee: Feronia S.A., Luxembourg (LU)

( * ) Notice: Subject to any disclaimer, the term of this patent is extended or adjusted under 35 U.S.C. 154(b) by 703 days.

(21) Appl. No.: 11/575,609

(22) PCT Filed: Sep. 21, 2005

(86) PCT No.: PCT/EP2005/054737

§ 371 (c)(1),
(2), (4) Date: Mar. 20, 2007

(87) PCT Pub. No.: WO2006/032684

PCT Pub. Date: Mar. 30, 2006

(65) Prior Publication Data

US 2009/0184439 A1 Jul. 23, 2009

(30) Foreign Application Priority Data

Sep. 21, 2004 (BE) ..... 2004/0461

(51) Int. Cl.
*E01B 19/00* (2006.01)
*E01C 19/00* (2006.01)

(52) U.S. Cl.
USPC ..... 238/382; 404/82

(58) Field of Classification Search
USPC ..... 238/2, 3, 8, 122, 125, 127, 139, 149, 238/150, 382; 264/261, 279; 156/60; 404/82
See application file for complete search history.

(56) References Cited

U.S. PATENT DOCUMENTS 1,771,078 A * 7/1930 Herbst ..... 238/9
6,270,017 B1 * 8/2001 Vennell ..... 238/1

FOREIGN PATENT DOCUMENTS

EP 854 234 A1 1/1998
EP 0584234 * 7/1998
EP 854234 * 7/1998
EP 863 256 A2 9/1998
EP 1279698 * 7/2002

* cited by examiner

*Primary Examiner* — R. J. McCarry, Jr.
(74) *Attorney, Agent, or Firm* — Sughrue Mion, PLLC

(57) ABSTRACT

The invention concerns a method for covering parts of a rail (1) for railway vehicles which are not in contact with the vehicle wheels, said method comprising applying a rubber jacket (6) on said parts and fixing said jacket to the rail, said jacket having outer lateral sides which extend along the rail, and for a predetermined load exerted by the vehicle on the rail, a distribution of said load between a first fraction exerted on the rail head (3) and a second fraction of said load exerted on the rail base (4) is determined, the geometry of each lateral side being configured to form a non-rectilinear profile allowing said distribution between said first and second fraction.

23 Claims, 6 Drawing Sheets

METHOD OF COVERING A RAIL FOR A RAILWAY VEHICLE

The present invention concerns a method of covering the parts of a rail for railway vehicles that are not in contact with the wheels of the vehicle, the said method comprising the application of a rubber jacket to the said parts and the fixing of this jacket to the rail, the said jacket having external lateral flanks that extend along the rail.

Such a method is known from the patent application EP 0854234. The jacket is formed from blocks of rubber that are applied both along the lateral flanks of the rail and under the base of the rail. The use of these jackets considerably reduces the vibrations caused in the ground by the vehicle when it passes over the rails. The reduction in vibration in its turn reduces nuisance and damage for neighbours.

One disadvantage of the known method is that all the jackets have the same configuration and fulfill only a function of absorbing vibration. In addition, the known jackets do not, through their geometry, which in general follows that of the rail, make it possible to act on the distribution of the loads applied by the vehicle when it is traveling on the rail covered with its jacket.

The aim of the invention is to implement a method of covering the parts of a rail for a railway vehicle that are not in contact with the wheels of the vehicle, where it is possible to adapt to the distribution of the loads applied to the rail by the vehicle.

For this purpose, a method according to the invention is characterized in that, for a predetermined load exerted by the said vehicle on the rail, a distribution of this load between a first fraction exerted on the head of the rail and a second fraction of this load exerted on the base of the rail is determined, the geometry of each lateral flank being configured so as to form a non-rectilinear profile allowing said distribution between the said first and second fractions. The distribution of the loads between those exerted on the head of the rail and those exerted on the base of the rail makes it possible better to manage the load exerted on the rail and thus to contribute not only to a reduction in the vibrations caused by the vehicle in the ground but also contributes to the comfort of the passengers using the vehicle and to the service life of the jacket. Configuring the geometry of each lateral flank according to the determined distribution of the loads makes it possible to give the jacket the flexibility and rigidity necessary for allowing this distribution.

A first preferential form of a method according to the invention is characterized in that the said geometry is configured in the form of a recess. The form of the recess makes it possible to direct the load towards the rail according to the given distribution.

Preferably the said recess is formed substantially circular. The circular form of the recess makes it possible to distribute the major part of the load on the head of the rail.

A second preferential form of a method according to the invention is characterized in that the said recess is formed substantially in a splayed U. This form makes it possible to arrive at a stiffness of approximately 80 MN/m per meter of rail.

A third preferential form of the method according to the invention is characterized in that the said recess is formed so as to possess a trapezoidal geometry. This form considerably reduces the vibrations caused in the ground by the vehicles passing over the rail.

A fourth preferential form of a method according to the invention is characterized in that a strip formed from a rubber that is more flexible than that of the jacket is placed under the base of the said rail, the said strip being housed between the bottom face of the base and the jacket. This strip of more flexible rubber affords a transfer of around 70% onto the base of the rail in order to arrive at a stiffness of the jacket of around 15 MN/m per meter of rail.

A fifth preferential form of a method according to the invention is characterized in that the jacket is formed by rubber granules connected together by an elastomer resin, in particular polyurethane, the granules having a particle size of between 0.5 and 6 mm, in particular between 1 and 3 mm. This makes it possible to produce a homogeneous jacket.

The concentration of ferrous, textile and plastics material in the rubber granules is preferably in each case less than 1%. This small concentration of ferrous material makes it possible to produce a jacket having poor electrical conductivity, which is favourable for reducing current losses. The small concentration of textile and plastic contributes to the homogeneity of the jacket.

Preferably, the density of the material forming the jacket is greater than 950 kg/m3, in particular equal to 1150 kg/m3. Such a density makes it possible to manufacture a jacket resistant in particular to road traffic.

A sixth preferential form of a method according to the invention is characterized in that the rail is placed in a mould and in that the granules and resin are mixed together and injected under high pressure into the mould. This injection at high pressure makes it possible to produce a jacket with a high density of material.

The invention also concerns a method of installing two rails in order to form a track in which rails covered by the use of the abovementioned method are used. Such a method is characterized in that the rails are mounted in an installation gantry in order to put them at a separation distance, the said rails then being disposed by means of the said gantry on a previously prepared base, and in that an aggregation of granules bound by means of a binder are then poured at least into the space between the two rails. This allows a rapid and effective installation of the rails.

Finally, the invention concerns a method of removing a rail installed by application of the aforesaid method. Such a method is characterized in that the jacket is cut over the height of the lateral flanks before removal of the rail and the remaining part applied to the rail of the jacket. It thus suffices to cut the jacket, to remove the cut assembly and to reinstall a new rail covered with its jacket.

The invention will now be described in more detail with the help of the drawings illustrating examples of the method according to the invention. In the drawings.

Figure 1:
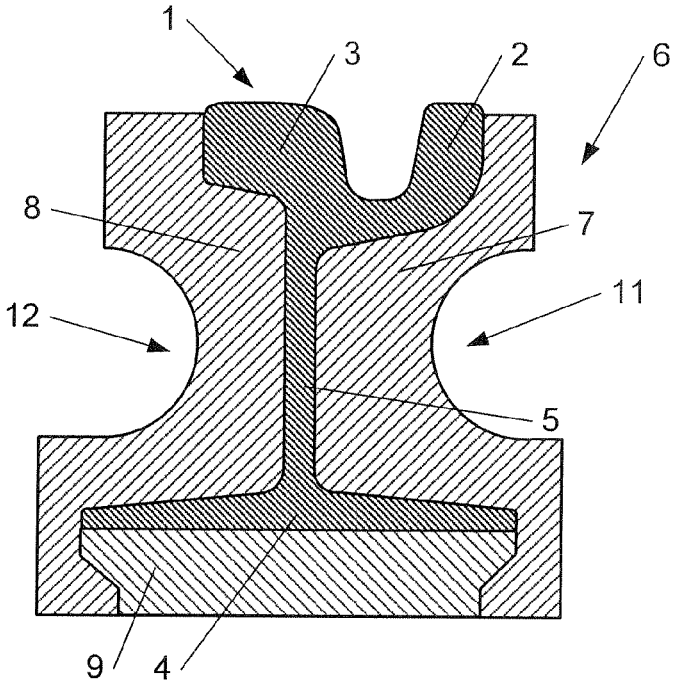
FIG. 1 shows a first embodiment of a rail covered by applying the method according to the invention.

In the drawings, the same references being allocated to the same element or to a similar element.

Figure 2:
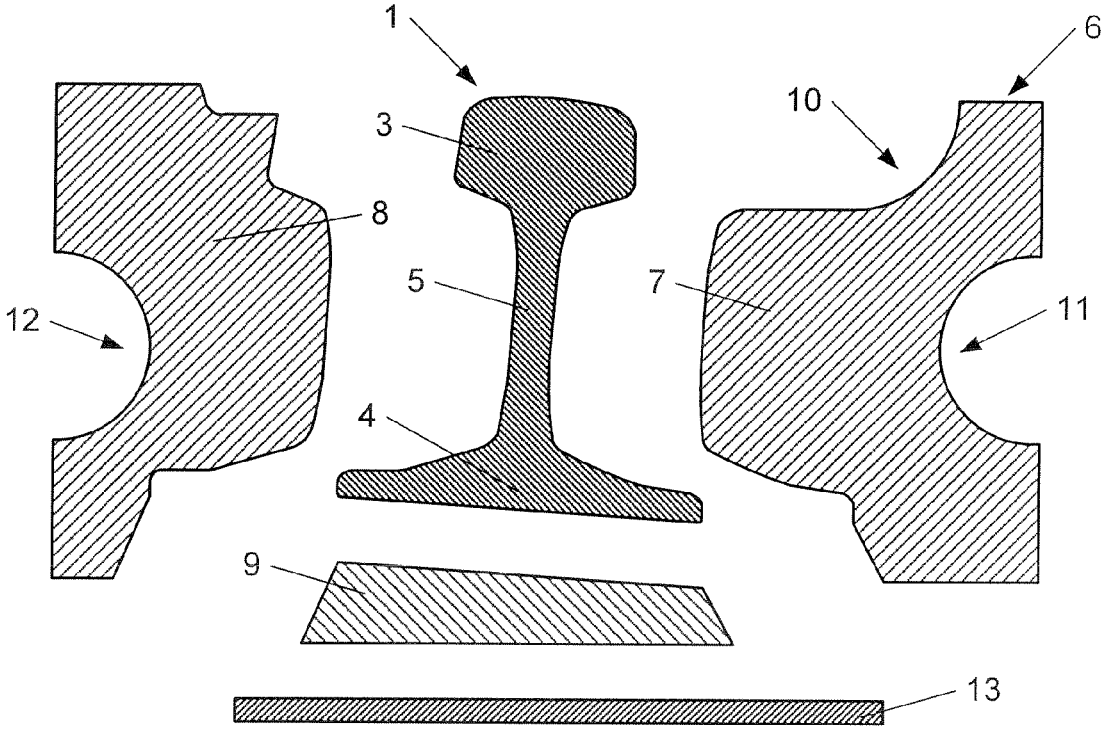
FIG. 2 shows an alternative form of the one illustrated in FIG. 1.

The rail 1 illustrated in FIG. 1 is a rail comprising a groove 2, while the rail illustrated in FIG. 2 does not comprise such a groove. Naturally the invention is not limited to a particular type of rail and applies both to rails with a groove and to rails without a groove as well as to other types of rail, such as the three-piece rail illustrated in FIG. 6. Each rail comprises a rail head 3 and a base 4 connected together by an upright 5.

The jacket 6 can consist either of a single piece or three pieces 7, 8 and 9. The jacket covers the parts of the rail for a railway vehicle that are not in contact with the wheels of the vehicle. The part in contact with the wheels of the vehicle must in fact remain free in order not to interfere with the passage of the wheel. When the jacket is in several parts, it is preferably adhesively bonded to the rail. On the other hand, when the jacket is in a single piece it is obtained by injection in a mould as will be described below.

In order to give the required properties to the jacket, the latter is manufactured from rubber, preferably recycled rubber obtained by grinding and sieving worn tyres. The jacket is formed from rubber granules having a particle size of between 0.5 and 6 mm, in particular between 1 and 3 mm. This fineness of granules makes it possible to compact the material from which the jacket is formed and thus to reduce the formation of air pockets within the jacket. The rubber granules are bound together by an elastomer resin, in particular polyurethane. In order to permit good connection of the granules by means of the resin, it is important for the granules to be clean and devoid of dust or other fats.

In order to reduce the electrical conductivity of the jacket, the concentration of ferrous materials is less than 1% of the total weight. This makes it possible to reduce leakages of electric current to earth and thus to electrically insulate the rail. The concentration of textile and/or plastics material in the rubber is also preferably less than 1% of the total weight. This is because these materials form a contaminant in the rubber of the jacket and could reduce the coherence between the granules.

The density of the material forming the jacket is greater than 950 kg/m3, in particular equal to 1150 kg/m3. Since these jackets are, with the rail that they cover, installed in the road where road vehicles also travel, it is important for these jackets to resist road traffic. A density greater than 950 kg/m3 affords good resistance to this type of traffic.

The jacket has a static Young's modulus greater than 5 MPa and a dynamic Young's modulus of less than 20 MPa.

The material from which the jacket if formed preferably also comprises additives such as anti-UV substances, as well as fire-retardant substances. This is because, the jackets being exposed to daylight, it is preferable to add anti-UV substances in order to prevent the light destroying the structure of the jacket in the long term. The presence of fire-retardant substances will preserve the jacket in the case where a vehicle on fire is situated on the rail.

The jacket has several functions. It seals the rail in its support and insulates it electrically and acoustically. When the jacket is manufactured in a single piece by injection in a mould reproducing the shape of the jacket, the rail is first of all placed in the mould. Next the rubber mixed with the binder and provided with the necessary additives is injected into the mould at high pressure. The high pressure prevents the formation of bubbles between the various granules and thus makes it possible to obtain a high-density compacted material.

The jackets can have many shapes, depending on the specific requirements of the various applications. FIG. 2 shows a jacket 6 for a symmetrical rail with a stub flangeway 10. The bottom part 9 of the jacket holds the rail at the required inclination. The top surface of the jacket is sized to permit the passage of the wheels of the vehicle without touching the cladding, taking into account a multitude of total wear on the rail and wheels.

The internal profile of the jacket follows that of the rail against which it is applied. The external profile of the lateral flanks of the jacket that extend along the rail is for its part determined by the required distribution of the load exerted by the vehicle when it travels on the rail. This is because the composition of the ground on which the rail covered with its jacket is placed, the proximity of buildings, the fact that the rail is situated on a separate bed or not, etc, require a particular distribution of the load exerted by the vehicle on the rail. The transfer of all the loads exerted on the rail must take place along the perimeter of the jacket in order to reduce to the maximum extent the vibrations caused in the ground. The geometry of the external lateral flanks of the jacket makes it possible, through the choice of particular shapes, to distribute the loads differently.

To arrive at this distribution, a distribution of a load between a first fraction exerted on the head 3 of the rail and a second fraction exerted on the base 4 of the rail is determined according to the ground and the aforesaid other parameters. This distribution between the head and the base of the rail makes it possible to guide the vibrations either in a vertical direction or in a horizontal direction according to the environment where the rail and its jacket will be installed. After the distribution of the load has been determined, the geometry of each lateral flank is configured so as to form a non-rectilinear profile that allows the determined distribution.

Figure 9:
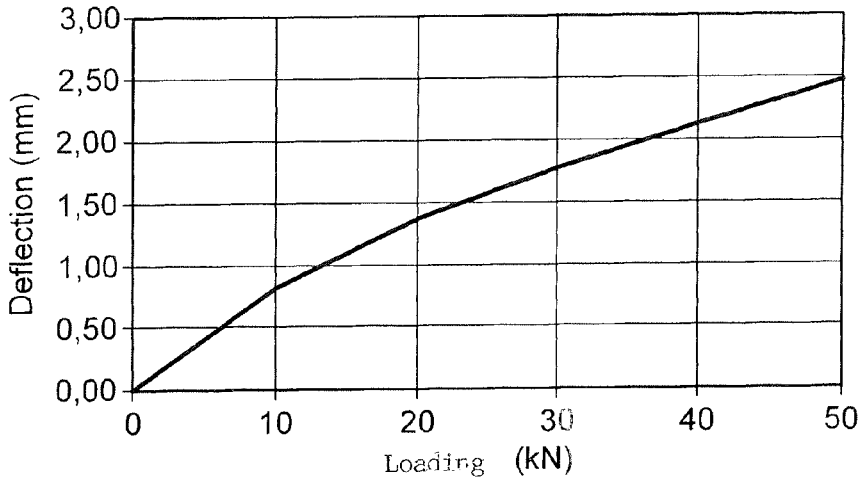
FIG. 9 shows the relationship between the deflection (in mm) of the rail/jacket complex and the load (in kN) imposed on the complex.
Figure 10:
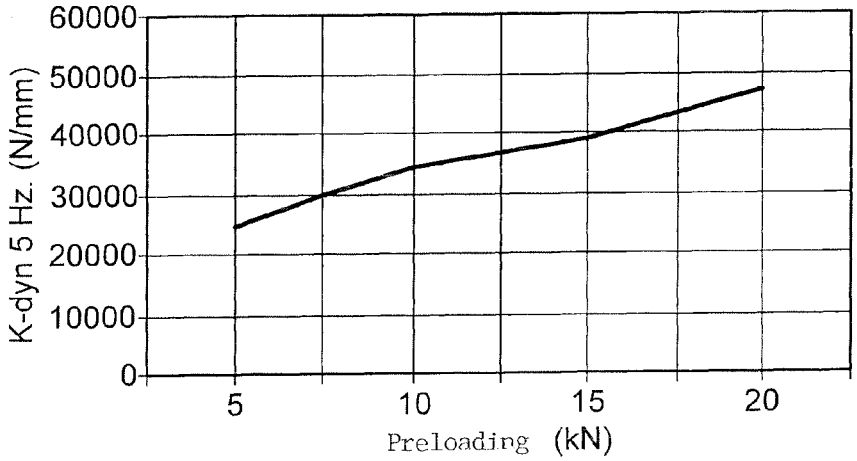
FIG. 10 illustrates the dynamic stiffness of the complex.
Figure 11:
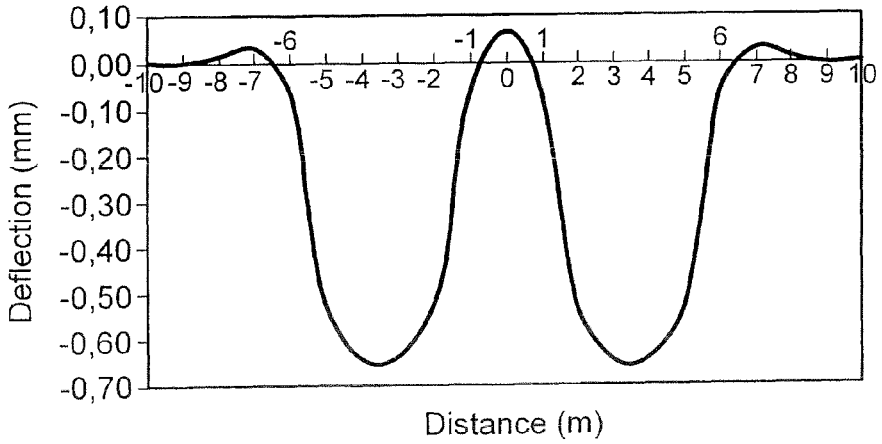
FIG. 11 shows the deflection of the vehicle bogie.

In the example embodiment illustrated in FIG. 1, the jacket has, in its external lateral flanks, substantially circle-shaped recesses 11 and 12. These recesses extend level with the upright 5 of the rail. This geometry allows a distribution of the ascending forces for the first fraction, that is to say that exerted on the head of the rail, situated between 60% and 80%, in particular 70%. For the second fraction, this geometry assumes between 40% and 20%, in particular 30%, of the load. This then makes it possible to arrive at a total stiffness of the rail/jacket complex of around 35 MN/m per meter of rail. As illustrated in FIG. 9, which shows the relationship between the deflection (in mm) of the rail/jacket complex and the load (in kN) imposed on the complex, the static stiffness of the rail/jacket complex follows a continuous curve, thus limiting the formation of jolts caused in the ground by the vehicle traveling on the rail. FIG. 10 illustrates the dynamic stiffness of the complex. This dynamic stiffness follows a substantially linear path. These properties of the rail/jacket complex also contribute to the comfort of the passengers. This is because, as illustrated in FIG. 11, which shows the deflection of the bogie, the latter undergoes a substantially sinusoidal undulation.

As illustrated in FIG. 1, the part of the jacket situated close to the base 4 is wider than that situated level with the head of the rail. This makes it possible to form a better support base in the ground. In addition, the thickness of the jacket is greater level with the upright 5 than that level with the head, thus making it possible to contribute favourably to distributing the major part of the load with the head of the rail. The jacket is also asymmetric in thickness level with the head. The part running along the stub is thinner than that situated on the opposite side to permit flexibility more towards the volume situated between the rails.

As illustrated in FIG. 2, the jacket can also have asymmetric recesses. This same FIG. 2 also illustrates that it is possible, by giving an inclination to the part 9 of the jacket situated under the base 4, to adjust the inclination of the rail. It is also possible to reduce further the acoustic insulation by placing a support plate 13 under the jacket.

Figure 3:
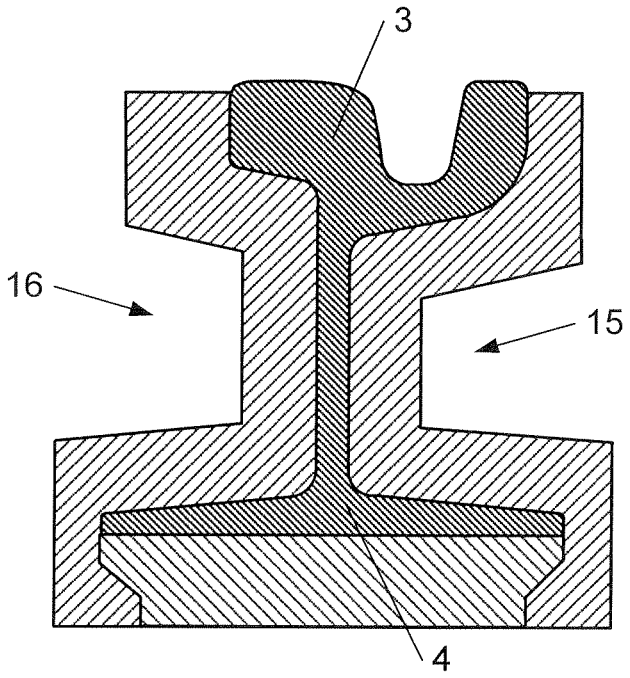
FIG. 3 shows a second embodiment of a rail covered by applying the method according to the invention.

FIG. 3 shows an embodiment of the jacket where the recesses 15 and 16 have substantially the shape of a splayed U. This shape allows a distribution of the loads that is substantially equal between the head 3 and base 4 of the rail. This then makes it possible to arrive at a total stiffness of the rail/jacket complex of around 80 MN/m per meter of rail. This solution is in general used in environments with a low density of buildings. The configuration illustrated in FIG. 3 also shows an asymmetric shape on the two lateral flanks on the jacket.

Figure 4:
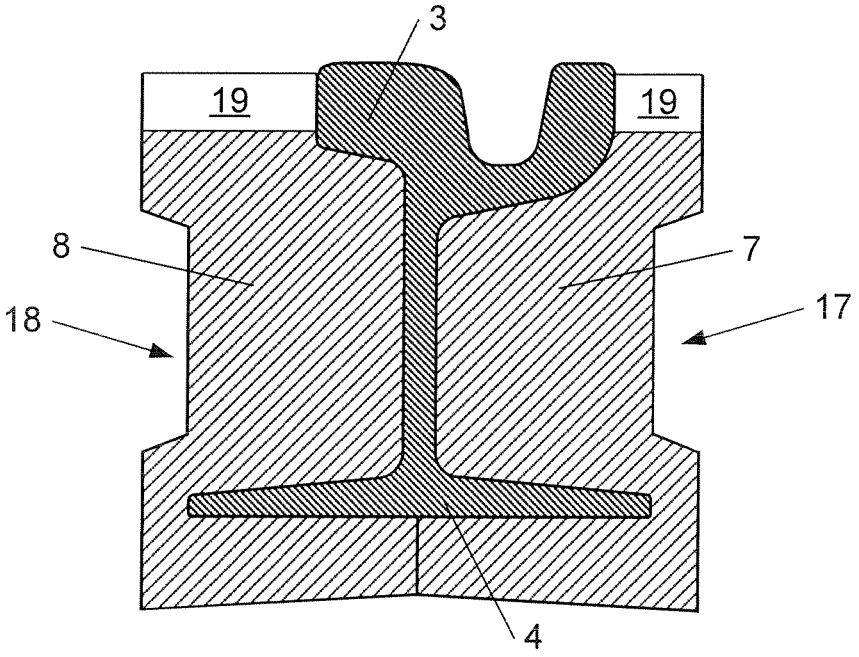
FIG. 4 shows a third embodiment of a rail covered by applying the method according to the invention.

FIG. 4 shows an embodiment of the jacket where the recess is formed so as to have a trapezoidal geometry. This geometry allows a distribution of the ascending forces for the first fraction situated between 20% and 40%, in particular 30%. For the second fraction this geometry assumes between 60% and 80%, in particular 70%, of the load. This then makes it possible to arrive at a total stiffness of the rail/jacket complex of around 25 MN/m per meter of rail.

As illustrated in FIG. 4, this embodiment makes it possible to manufacture a jacket that has only two parts 7 and 8. In addition, a seal 19 can be poured along the head of the rail.

Figure 5:
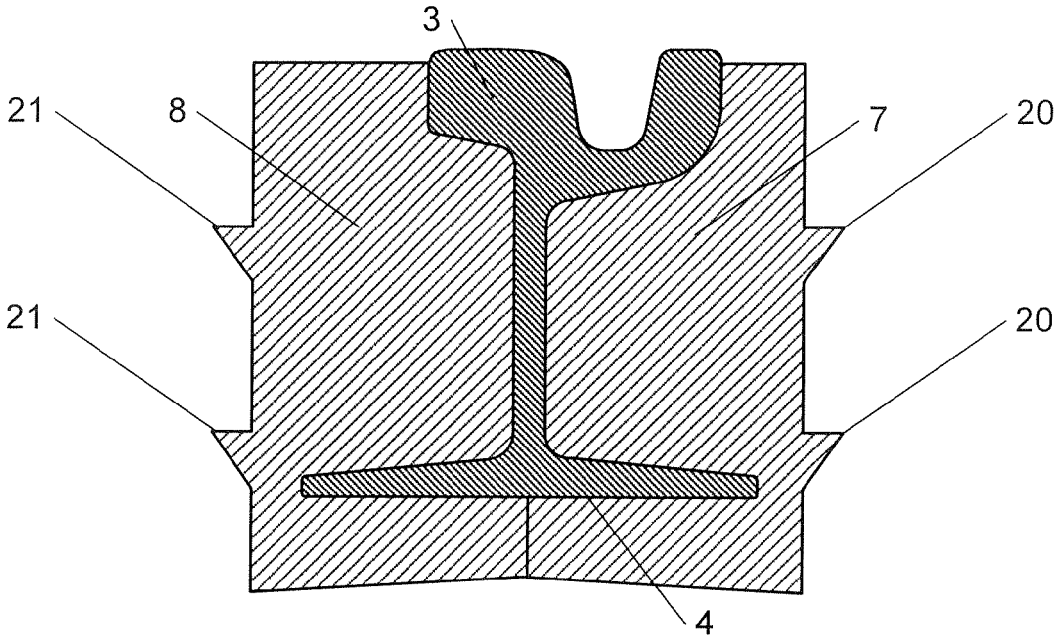
FIG. 5 shows a rail covered with a jacket enabling the rail to be renewed without removing the cladding.

FIG. 5 shows an embodiment of the jacket where the geometry is formed by protuberances 20 and 21. This geometry allows an equal distribution of the load over the whole of the jacket.

Figure 6A:
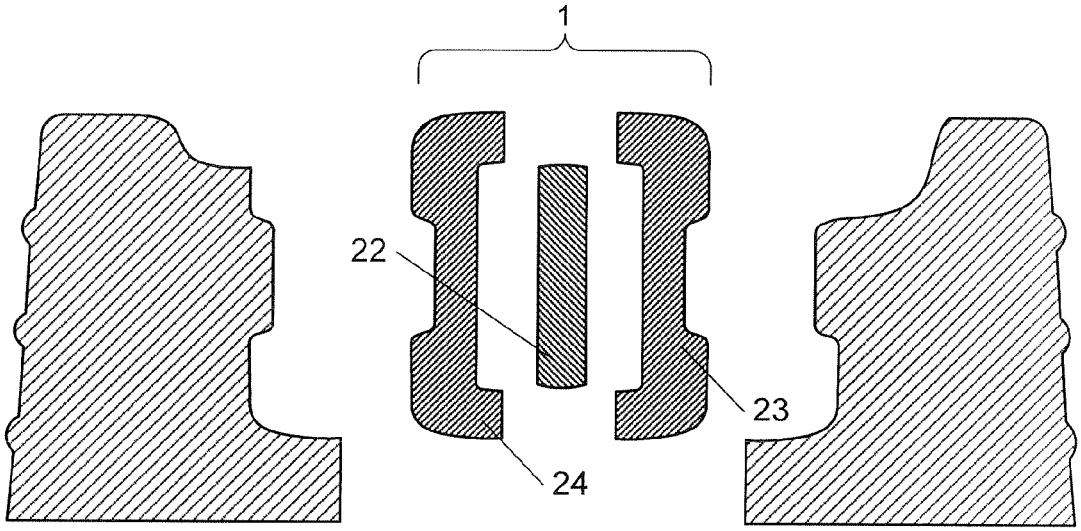
FIG. 6 shows an embodiment for a three-piece rail.
Figure 6B:
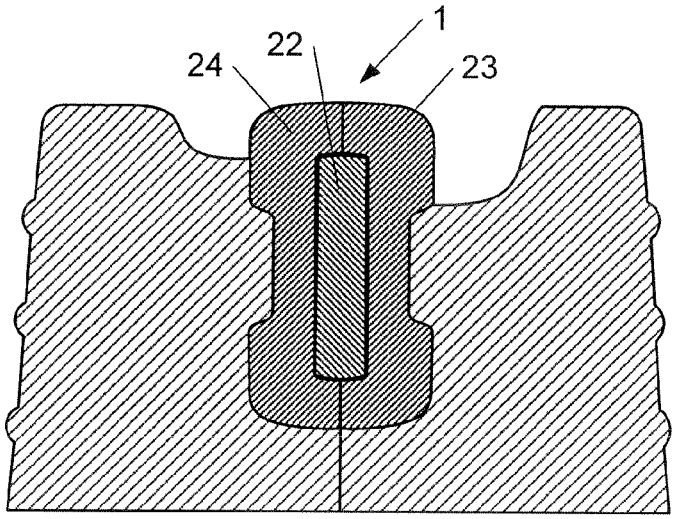

FIG. 6*a* shows an embodiment for a rail 1 with three components 22, 23 and 24. As illustrated in FIG. 6*b*, it is the jacket that holds the components of the rail.

Figure 8:
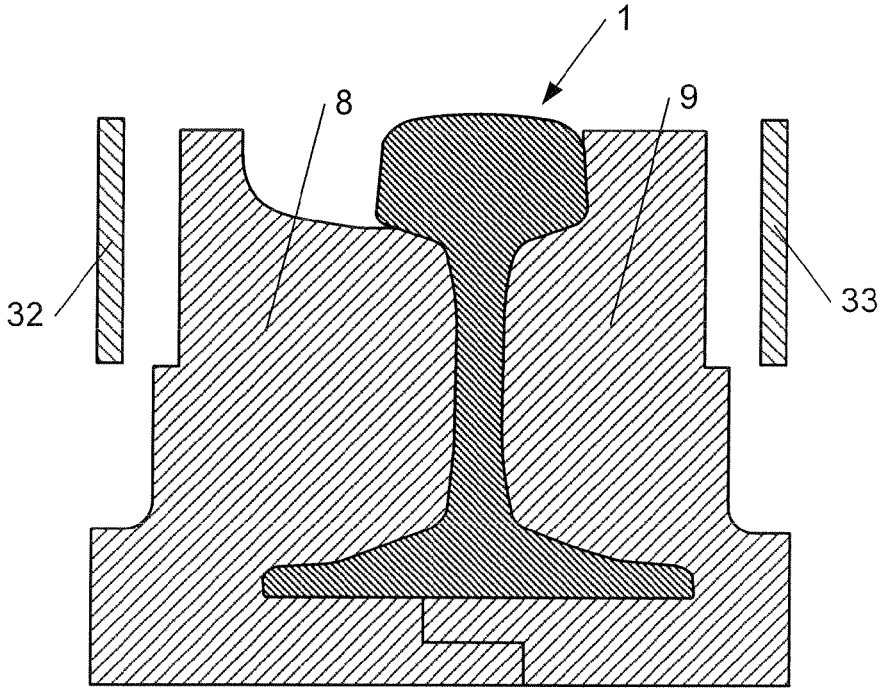
FIG. 8 shows a jacket with a metal flap for propping the cladding.

FIG. 8 shows a rail provided with its jacket as well as metal cladding-prop plates 32 and 33. These plates make it possible to form an intermediate piece between the cladding and the jacket and thus protect the jacket.

It is also possible to place under the base of the rail a strip formed from a rubber more flexible than that from which the jacket is manufactured. The strip is housed between the bottom face of the base and the jacket and reduces vibration further.

Figure 7:
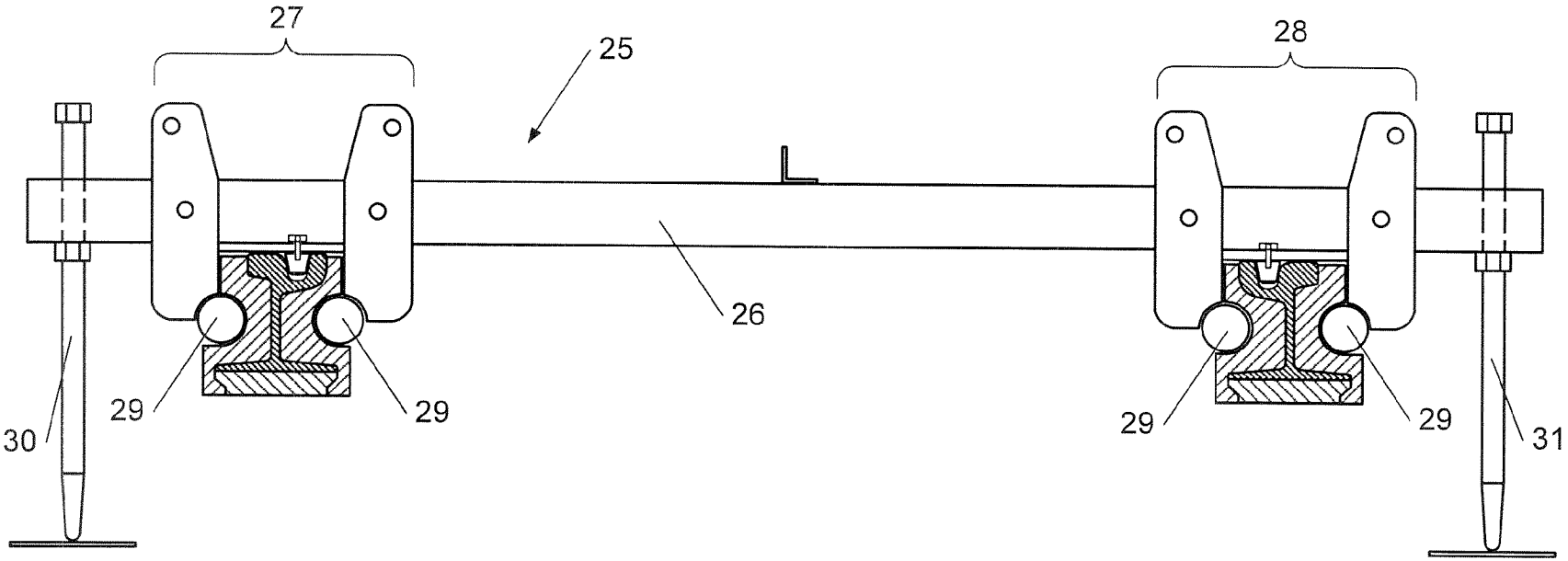
FIG. 7 shows the method of installing two covered rails.

The protuberances or recesses not only serve to permit a distribution of the loads but also to form a grip for a concrete, bitumen or other aggregation of granules bound by means of a binder. This is because, when the rail is covered in its jacket, it can be set at a separation distance without having recourse to iron cross-members screwed to the rail. The placing of the rail/jacket complex is carried out by means of an installation gantry. As illustrated in FIG. 7, the installation gantry 25 comprises a transverse arm 26 on which jaws 27 and 28 are mounted so as to establish a separation between the rails. The jaws are provided with gripping elements 29 configured so as to correspond to the profile applied in the external flanks of the jacket. Thus these elements 29 can grip on the jacket. Finally, the installation gantry comprises two lateral screws 30 and 31. The installation gantry holds the rail/jacket complex by jaws and is inserted in the lateral spaces left in the flanks of the jacket. A separation device adapted to keep the two rails to be installed at the correct separation. The two lateral screws 30 and 31 bring the assembly to the correct level.

Another gantry system supports the rail by a steel flat passing under the isosceles and connected to the installation gantry by two bolts. The assembly is mounted on a slide to enable the track to be built.

In order to make the execution of the work more rapid, the rail/jacket complex is inserted in a prefabricated beam and delivered to the site after drying. These elements have variable lengths according to the requirements of the site and can range up to 25 meters long. These beam elements are reinforced so as to be able to withstand the passage of the rolling stock (tram, etc) on supports every 3 meters. The beams have two lateral surfaces able to receive prefabricated cladding elements. The visible part of the beam is designed to receive a cladding element of a modular type (brick, concrete paving stones, fastenings) or in order to be planted at the necessary height to lay an asphalt or other cladding.

The material making up the beam may project beyond the frame constituting the beam in order to be held in the fixing concretes. In order to reduce the time for performing the work, prefabricated cladding elements are inserted between the beams and outside these in order to completely produce the whole of the track. These panels are locked by injecting concrete under all the prefabricated elements once these are adjusted. The space between the modules is closed by a suitable seal. The prefabricated claddings can contain any type of cladding normally employed in roadways.

In order to carry out the work more quickly, especially at intersections, or to give access to priority neighbours, the two rails of one and the same track are included in a concrete slab in which there are also included the end-of-site border and the platform heads. When the earthworks of the track housing are carried out, a subfoundation may be executed at the bottom of the housing. Once this has been done, concrete fixing beams are placed and adjusted approximately.

The intersection slabs are then deposited on these and adjusted by interposing wedges of variable thickness. The intersection can be treated as two or three slabs in its width. Intersections can be treated in several slabs along their length. Spaces between slabs are then left in order to effect the welding of rails between the various modules. At this point, the smaller slabs are attached to the track slabs in order to ensure continuity of the cladding.

Once the slabs are correctly positioned, the welds carried out and the intermediate slabs positioned, a liquid concrete is injected under all the elements constituting the tracks and locks these definitively. If, on each side of these prefabricated track modules, the track installation is different, transition zones are added to ensure a transition between the stiffnesses and also to enable adjacent sleepers to be padded in the case of ballasted tracks.

The rail/jacket complex also makes it possible to remove the rail easily. This is because it suffices to cut the jacket over the height of the lateral flanks. The rail and the remaining parts bonded to the rail are then removed, for example by means of a crane. A new rail provided with a jacket part can then be placed in the opening obtained after removal of the cut parts.

The invention claimed is:

1. Method of covering the parts of a rail for railway vehicles, which parts are not in contact with the wheels of said vehicle, said method comprising:

for a predetermined load exerted by said vehicle on said rail, determining a distribution of this load between a first fraction of this load exerted on a head of said rail and a second fraction of this load exerted on a base of said rail;

responsive to the determining step, configuring a rubber jacket having external lateral flanks provided to extend along said rail, whereby each lateral flank of said rubber jacket has a geometry configured so as to form a non-rectilinear profile allowing said distribution between said first and second fractions and a transfer of said load along the perimeter of said jacket; and applying said rubber jacket to parts of said rail and fixing said rubber jacket to said rail.

2. Method according to claim 1, wherein said geometry is configured in the form of a recess applied in said jacket.

3. Method according to claim 2, wherein said recess is formed substantially circular.

4. Method according to claim 2, wherein said recess is formed substantially in a splayed U.

5. Method according to claim 2, wherein said recess is formed so as to have a trapezoidal geometry.

6. Method according to claim 1, wherein said geometry is configured in the form of a protuberance comprising at least one ridge.

7. Method according to claim 1, wherein said first fraction is situated between 60% and 80% of said load and said second fraction is situated between 40% and 20% of said load.

8. Method according to claim 7, wherein said first fraction comprises 70% of said load and said second fraction comprises 30% of said load.

9. Method according to claim 1, wherein said first fraction is situated between 20% and 40%, and said second fraction is situated between 60% and 80% of said load.

10. Method according to claim 9, wherein said first fraction comprises 30% of said load and said second fraction comprises 70% of said load.

11. Method according to claim 1, wherein under said base of said rail, there is placed a strip formed from a rubber more flexible than that of said jacket, said strip being housed between a bottom face of said base and said jacket.

12. Method according to claim 1, wherein said jacket is formed from rubber granules bound together by an elastomer resin, said granules having a particle size of between 0.5 and 6 mm.

13. Method according to claim 12, wherein said elastomer resin is a polyurethane.

14. Method according to claim 12, wherein said granules have a particle size between 1 and 3 mm.

15. Method according to claim 12, wherein a concentration of ferrous, textiles and plastics material in said rubber granules is less than 1%.

16. Method according to claim 12, wherein in order to form said jacket, anti-UV substances and fire-retardant substances are added before binding the granules together.

17. Method according to claim 12, wherein said rail is placed in a mould, and said granules and resin are mixed together and injected into said mould at high pressure.

18. Method according to claim 1, wherein the density of a material forming said jacket is greater than 950 $kg/m^3$.

19. Method according to claim 18, wherein said density is equal to 1150 $kg/m^3$.

20. Method according to claim 1, wherein said jacket has a static Young's modulus greater than 5 MPa and a dynamic Young's modulus of less than 20 MPa.

21. Method of installing two rails in order to form a track in which rails covered by the use of the method according to claim 1 are used, wherein said rails are mounted in an installation gantry in order to set them at a separation distance, said rails then being disposed by means of said gantry on a previously prepared base, and wherein an aggregation of granules bound by means of a binder is poured at least into a space between said two rails.

22. Method according to claim 21, wherein a road covering is laid on said aggregation after drying of the latter.

23. Method of removing a rail installed by applying the method according to claim 21, wherein said jacket is cut over a height of said lateral flanks before said rail is removed and a remaining part of said jacket applied to said rail.

* * * * *